US008141977B2

(12) United States Patent
Lee et al.

(10) Patent No.: US 8,141,977 B2
(45) Date of Patent: Mar. 27, 2012

(54) INKJET HEAD MODULE AND METHOD OF ALIGNING INKJET HEAD USING THE SAME

(75) Inventors: Ro-Woon Lee, Seongnam-si (KR); Jae-Woo Joung, Suwon-si (KR); Shang-Hoon Seo, Seoul (KR); Young-Seuck Yoo, Seoul (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 108 days.

(21) Appl. No.: 12/568,279

(22) Filed: Sep. 28, 2009

(65) Prior Publication Data

US 2010/0182382 A1 Jul. 22, 2010

(30) Foreign Application Priority Data

Jan. 21, 2009 (KR) ..... 10-2009-0005146

(51) Int. Cl.
*B41J 29/393* (2006.01)

(52) U.S. Cl. ..... 347/19; 68/20

(58) Field of Classification Search ..... None
See application file for complete search history.

(56) References Cited

U.S. PATENT DOCUMENTS 7,648,215 B2 * 1/2010 Song et al. ..... 347/8
2005/0156963 A1 * 7/2005 Song et al. ..... 347/9

* cited by examiner

*Primary Examiner* — Matthew Luu
*Assistant Examiner* — Erica Lin
(74) *Attorney, Agent, or Firm* — McDermott Will & Emery LLP

(57) ABSTRACT

An inkjet head module and a method of aligning inkjet heads using the inkjet head module are disclosed. The inkjet head module can include a frame, which can be attached to and detached from an inkjet apparatus; a multiple number of heads, which may be coupled to the frame, and which may each have at least one nozzle formed for ejecting ink; a multiple number of support racks, each of which may be interposed between the frame and a head, and which may support the head such that the head is movable in relation to the frame; and a multiple number of piezoelectric motors, which may move the heads to align the heads in relation to one another. Certain embodiments of the invention make it possible to reduce the size of the overall inkjet apparatus, as well as to align a multiple number of inkjet heads with higher precision.

7 Claims, 6 Drawing Sheets

INKJET HEAD MODULE AND METHOD OF ALIGNING INKJET HEAD USING THE SAME

CROSS-REFERENCE TO RELATED APPLICATIONS

This application claims the benefit of Korean Patent Application No. 10-2009-0005146, filed with the Korean Intellectual Property Office on Jan. 21, 2009, the disclosure of which is incorporated herein by reference in its entirety.

BACKGROUND

1. Technical Field

The present invention relates to an inkjet head module and to a method of aligning inkjet heads using the inkjet head module.

2. Description of the Related Art

Inkjet printing generally involves ejecting ink in the form of droplets through the nozzles of an inkjet head. The competitiveness of inkjet printing technology has been recognized in the fields of OLED (organic light emitting diode), LCD (liquid crystal display), PDP (plasma display panel), FED (field emission display), etc., and as such, there has been active research on inkjet printing in these areas.

In forming circuit patterns, etc., using the inkjet printing technology, requirements for higher productivity make it essential to install multiple inkjet heads on the inkjet apparatus. As such, there is a demand also for techniques for aligning inkjet heads.

In the related art, a system for aligning multiple inkjet heads may be included within the inkjet apparatus. In certain examples, a motor having a rotating shaft may be installed on each of the inkjet heads. The motor may be operated to alter the displacement along the x- and y-axes and the rotation angle θ about the z-axis, to adjust the levelness, intervals, etc., of the multiple number of inkjet heads.

With this method, however, the aligning of multiple inkjet heads may require numerous motors, as well as driving shafts, etc., for transferring power from the rotating shafts of the motors, leading to an increase in the size and cost of the overall inkjet apparatus. Also, the use of motors relying on rotating shafts may involve a high risk of mechanical errors, etc., resulting in lower precision in aligning the inkjet heads.

SUMMARY

An aspect of the invention is to provide an inkjet head module and a method of aligning inkjet heads using the inkjet head module that make it possible to reduce the size of the overall inkjet apparatus and to align a multiple number of inkjet heads with higher precision.

Another aspect of the invention provides an inkjet head module that includes a frame, which can be attached to and detached from an inkjet apparatus; a multiple number of heads, which may be coupled to the frame, and which may each have at least one nozzle formed for ejecting ink; a multiple number of support racks, each of which may be interposed between the frame and a head, and which may support the head such that the head is movable in relation to the frame; and a multiple number of piezoelectric motors, which may move the heads to align the heads in relation to one another.

Here, the piezoelectric motor can be configured to translate or rotate the head.

The piezoelectric motor can include: a first unit motor, configured to translate the head in a lateral direction, and a pair of second unit motors, configured to translate the head in a longitudinal direction or rotate the head about an axis perpendicular to the lateral and the longitudinal directions.

The support rack can provide an elastic force on the head moved by an operation of the piezoelectric motor.

Also, the support rack can include: a mounting portion, to which the head may be secured; a coupling portion, which may be separated from the mounting portion, and which may be secured to the frame; and an elastic portion, which may be interposed between the mounting portion and the coupling portion, and which may be configured to provide an elastic force on the mounting portion.

Here, the coupling portion can surround the mounting portion, while the elastic portion can include: a supporting strip, which may surround the mounting portion, and which may be separated from the mounting portion and the coupling portion; and a pair of elastic strips, which may connect the mounting portion with the supporting strip and connect the coupling portion with the supporting strip, respectively.

Yet another aspect of the invention provides a method of aligning a multiple number of inkjet heads by using an inkjet head module that includes a frame, the multiple number of heads coupled to the frame, a multiple number of support racks interposed between the frame and the heads to support the heads such that the heads are movable in relation to the frame, and a multiple number of piezoelectric motors configured to move the heads. The method can include: aligning the heads in relation to one another by moving the heads with the piezoelectric motors; collecting alignment data corresponding to how much each of the piezoelectric motors operated to align the heads; installing the inkjet head module on an inkjet apparatus; and realigning the heads in relation to one another by operating the piezoelectric motors in accordance with the alignment data.

Here, the piezoelectric motor can be configured to translate or rotate the head.

The piezoelectric motor can include: a first unit motor, configured to translate the head in a lateral direction, and a pair of second unit motors, configured to translate the head in a longitudinal direction or rotate the head about an axis perpendicular to the lateral and the longitudinal directions.

The alignment data may correspond to electrical signals transmitted respectively to each of the heads for operating the piezoelectric motors.

The support rack can provide an elastic force on the head moved by an operation of the piezoelectric motor.

Also, the support rack can include: a mounting portion, to which the head may be secured; a coupling portion, which may be separated from the mounting portion, and which may be secured to the frame; and an elastic portion, which may be interposed between the mounting portion and the coupling portion, and which may be configured to provide an elastic force on the mounting portion.

Here, the coupling portion can surround the mounting portion, while the elastic portion can include: a supporting strip, which may surround the mounting portion, and which may be separated from the mounting portion and the coupling portion; and a pair of elastic strips, which may connect the mounting portion with the supporting strip and connect the coupling portion with the supporting strip, respectively.

Additional aspects and advantages of the present invention will be set forth in part in the description which follows, and in part will be obvious from the description, or may be learned by practice of the invention.

DETAILED DESCRIPTION

Figure 1:
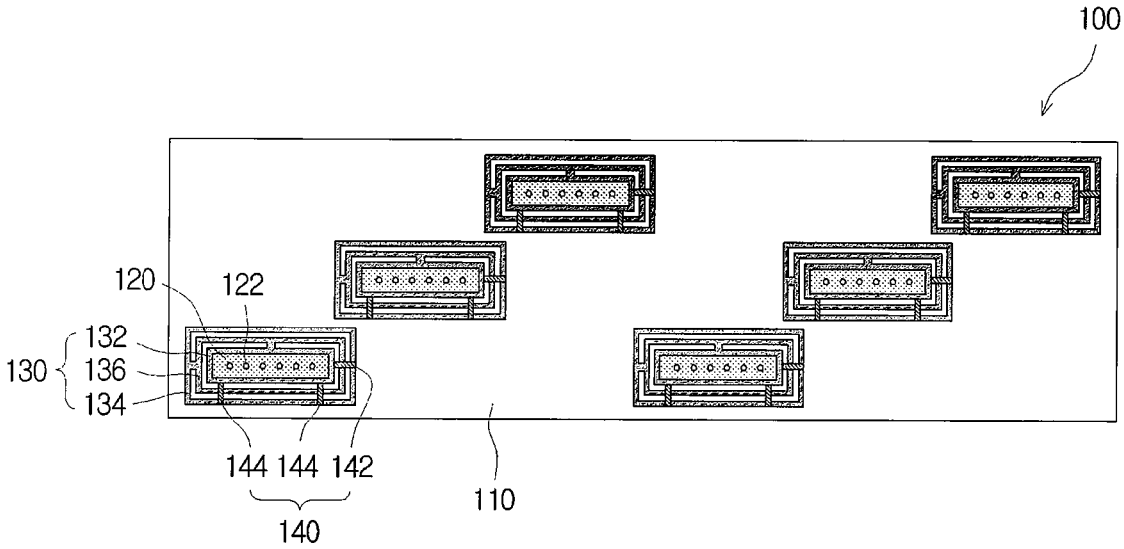
FIG. 1 is a bottom view illustrating an embodiment of an inkjet head module according to an aspect of the invention.

Certain embodiments of the invention will be described below in more detail with reference to the accompanying drawings. Those components that are the same or are in correspondence are rendered the same reference numeral regardless of the figure number, and redundant descriptions are omitted.

It is to be appreciated that the terms "coupled," "interposed," and "secured" are not limited to those cases where the components in question are in direct physical contact, but rather encompass those cases where one or more other elements are positioned between the components with the components placed in contact with the interposed elements.

Figure 2:
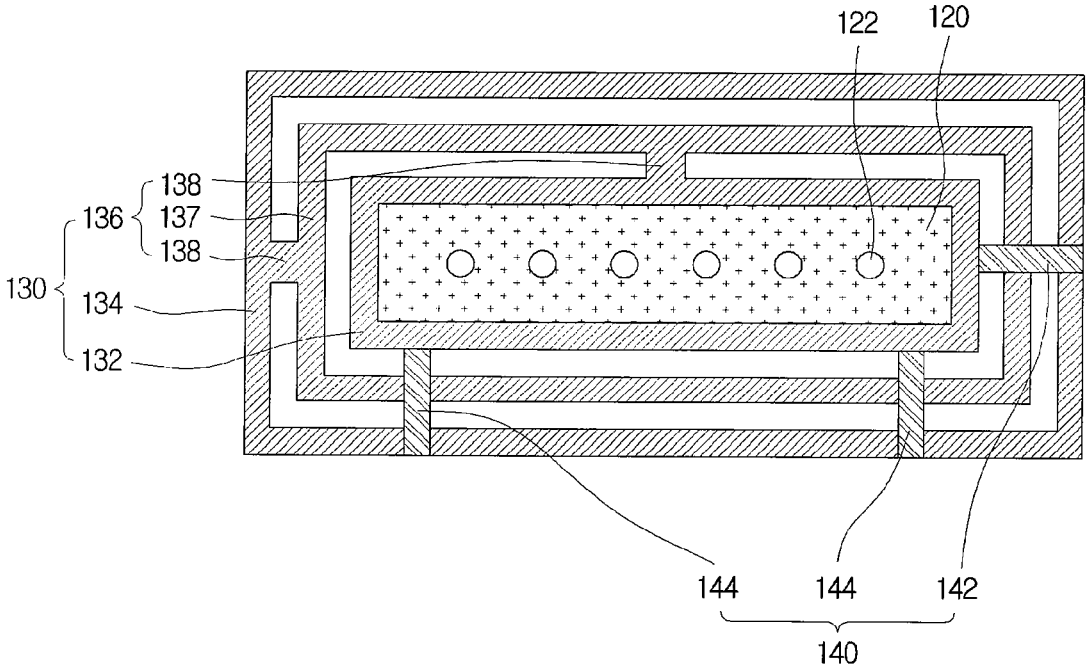
FIG. 2 is a bottom view illustrating a portion of an embodiment of an inkjet head module according to an aspect of the invention.
Figure 3:
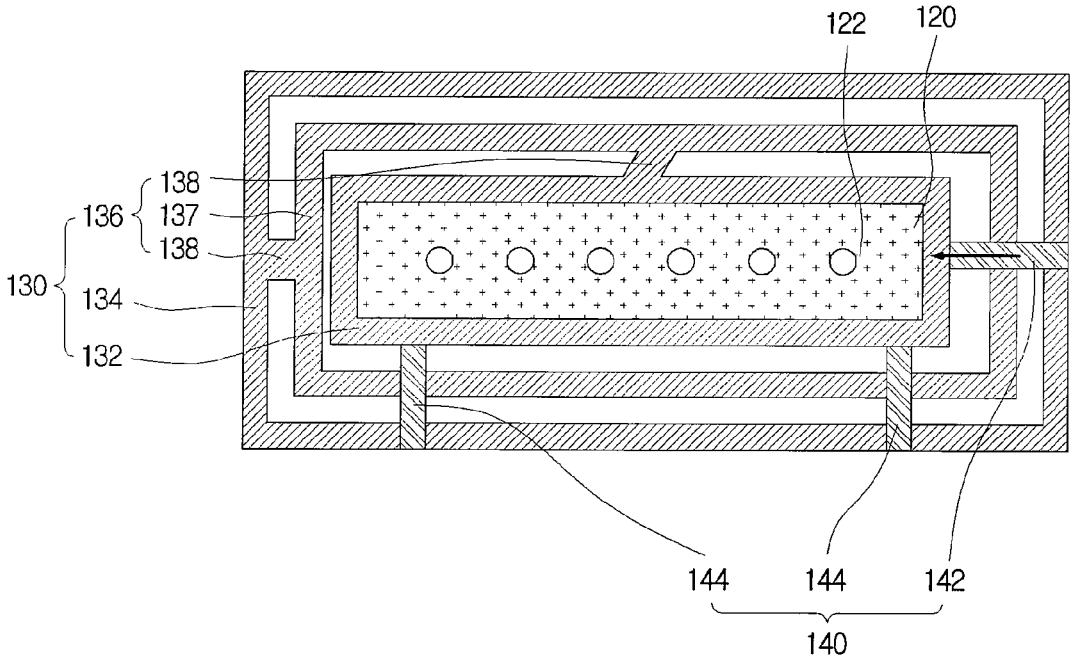
FIG. 3, FIG. 4, and FIG. 5 are bottom views illustrating the operation of an inkjet head module according to an aspect of the invention.
Figure 4:
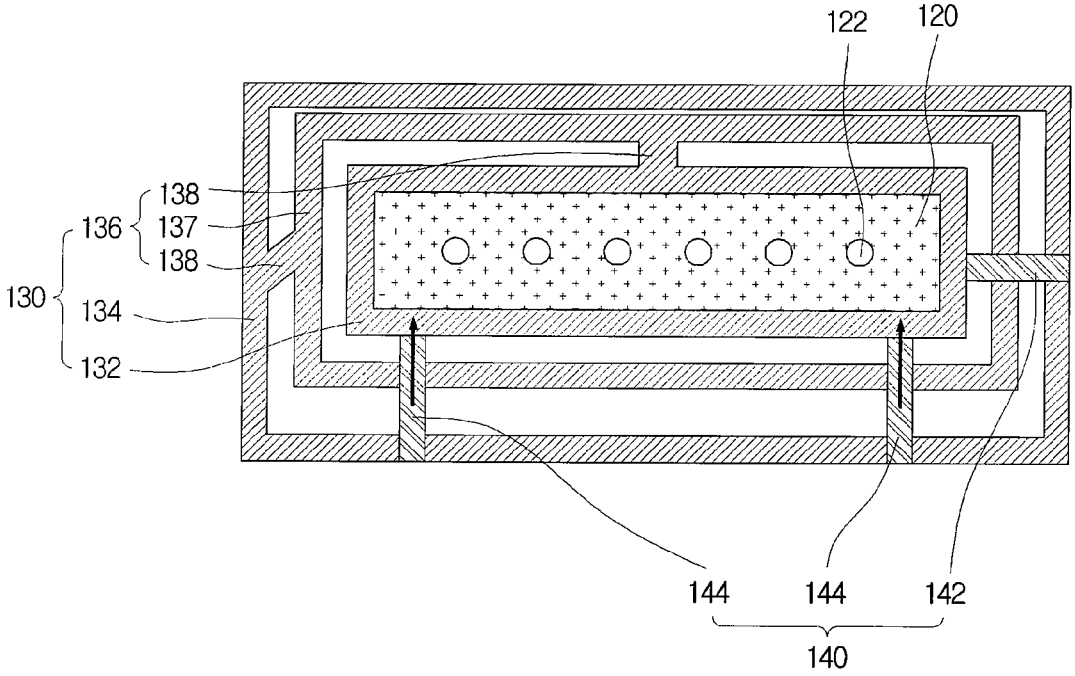
Figure 5:
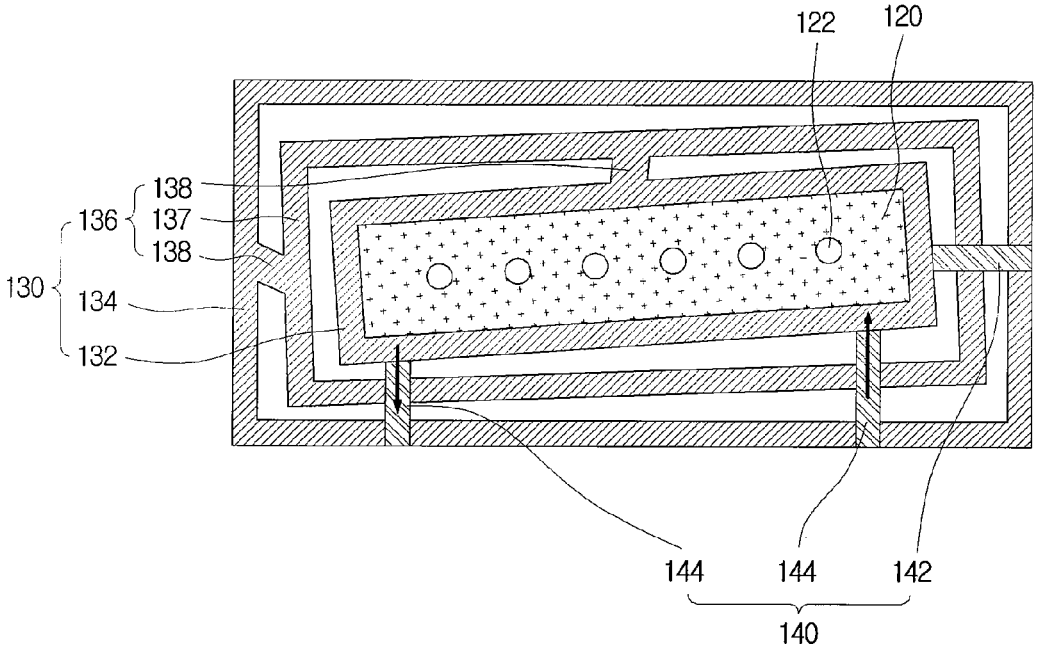

FIG. 1 is a bottom view illustrating an embodiment of an inkjet head module 100 according to an aspect of the invention. FIG. 2 is a bottom view illustrating a portion of an embodiment of an inkjet head module 100 according to an aspect of the invention. FIG. 3 through FIG. 5 are bottom views illustrating the operation of an inkjet head module 100 according to an aspect of the invention.

As illustrated in FIGS. 1 to 5, an inkjet head module 100 according to an embodiment of the invention can include a frame 110, which is attachable to and detachable from an inkjet apparatus, a multiple number of heads 120, each of which may be coupled to the frame 110 and include at least one nozzle 122 for ejecting ink, a multiple number of support racks 130, each of which may be interposed between the frame 110 and a head 120 to support the head 120 in a manner that allows movement in relation to the frame 110, and a multiple number of piezoelectric motors 140, which may move the multiple heads 120 and align the heads 120 in relation to one another.

In this embodiment, the inkjet head module 100 can be separated as an individual module from the inkjet apparatus that manipulates the heads 120. Thus, certain parts, such as the alignment camera, etc., required for aligning the heads 120 can be omitted in the inkjet apparatus, and the overall size of the inkjet apparatus can be reduced.

Also, by utilizing piezoelectric motors 140 and support racks 130, each of the heads 120 can be moved in minute distances, so that the heads 120 may be aligned relative to one another with greater precision.

The components of the inkjet head module 100 will be described below in more detail with reference to FIGS. 1 to 5.

An inkjet head module 100 according to this embodiment can be installed on an inkjet apparatus that manipulates the heads 120 to eject ink. That is, the inkjet apparatus can be composed of an ink storage unit for storing ink, an ink transport unit for supplying ink to the heads 120, and a control unit for controlling electrical signals, etc., that manipulate the heads 120. The inkjet head module 100 can be installed onto this type of inkjet apparatus, to be used in manipulating the heads 120 for inkjet printing.

The inkjet head module 100 can mainly include a frame 110 as well as heads 120, support racks 130, piezoelectric motors 140, etc., which may be equipped directly or indirectly on the frame 110.

The frame 110 can be attachable to and detachable from the inkjet apparatus. Thus, instead of having the system for aligning the head 120 built-in within the inkjet apparatus, the system can be implemented independently from the inkjet apparatus in the form of an inkjet head module 100.

As the inkjet head module 100 can be attached to and detached from the inkjet apparatus as an independent module, the overall size of the inkjet apparatus may be reduced.

Aligning multiple heads 120 can require an alignment camera, for identifying the positions of the heads 120, as well as additional control units, electrical wiring, etc., for controlling the movement of the camera and the heads 120. If this system for aligning the heads 120 is built in within the inkjet apparatus, the overall size of the inkjet apparatus can be increased considerably.

However, when using an inkjet head module 100 as in this embodiment, the alignment system including parts for aligning the heads 120, such as the alignment camera, control unit, wiring, etc., can be implemented separately from the inkjet apparatus. With this alignment system, the heads 120 can be aligned using piezoelectric motors 140, before installing the inkjet head module 100 on the inkjet apparatus, in order to collect alignment data needed for aligning the heads 120 after installing the inkjet head module 100 on the inkjet apparatus.

As a result, the parts required for aligning the heads 120, such as the alignment camera, control unit, wiring, etc., can be omitted in the inkjet apparatus, and the overall size of the inkjet apparatus can be reduced.

As illustrated in FIG. 1 and FIG. 2, each of the multiple number of heads 120 can be coupled to the frame 110 by way of an interposed support rack 130 and can include nozzles 122 through which ink may be ejected. The heads 120 can be fitted onto the support racks 130 to be movable with respect to the frame 110.

Here, the support racks 130 may be respectively interposed between the frame 110 and the heads 120, as illustrated in FIG. 1 and FIG. 2, to support the heads 120 in a manner that allows movement in relation to the frame 110. A support rack 130 can include a mounting portion 132, to which the head 120 may be secured, a coupling portion 134, which may be separated from the mounting portion 132 and secured to the frame 110, and an elastic portion 136, which may be interposed between the mounting portion 132 and the coupling portion 134 to serve as a spring that provides an elastic force on the mounting portion 132.

With the support rack 130 formed in this manner of a mounting portion 132 and a separated coupling portion 134, the position of the head 120 can be changed by altering the distance between the mounting portion 132 and the coupling portion 134.

The elastic force provided on the mounting portion 132 by the elastic portion 136 can act as a supporting force. Thus, the position of the head 120 may be kept stable by an interaction between the load applied on the head 120 due to the operation of the piezoelectric motor 140 and the elastic force provided by the elastic portion 136 on the mounting portion 132.

The elastic force applied by the elastic portion 136 on the mounting portion 132 can also act as a restoring force. Thus, after the head 120 is moved according to the operation of the piezoelectric motor 140, the head 120 may be restored to its original position that was before the operation of the piezoelectric motor 140, when the operation of the piezoelectric motor 140 is discontinued.

Using the alignment system described above, each of the heads 120 can be moved in a lateral direction (along the x-axis, the same hereinafter) and a longitudinal direction (along the y-axis, the same hereinafter), and rotated by a particular angle θ about an axis perpendicular to the lateral and longitudinal directions (the z-axis, the same hereinafter) such that the heads 120 are aligned in relation to one another, and the data can be collected as alignment data, i.e. data corresponding to electrical signals, etc., transmitted to each of the piezoelectric motors 140 for alignment. Since the heads 120 can always maintain original positions when the piezoelectric motors 140 are not operated, the alignment data thus collected can later be used directly in the inkjet head module 100 installed on the inkjet apparatus to precisely align the heads 120 without error.

As illustrated in FIGS. 1 and 2, the coupling portion 134 can be formed to surround the mounting portion 132. Also, the elastic portion 136 can include a supporting strip 137, which may surround the mounting portion 132 and may be separated from both the mounting portion 132 and the coupling portion 134, and a pair of elastic strips 138, which may connect the mounting portion 132 with the supporting strip 137 and the coupling portion 134 with the supporting strip 137, respectively.

That is, a support rack 130 can include: several holes in the board material that extend along the lateral and longitudinal directions, as illustrated in FIGS. 1 and 2, to form a mounting portion 132; a supporting strip 137, surrounding and separated from the mounting portion 132; a coupling portion 134, surrounding and separated from the supporting strip 137; and a pair of elastic strips 138, one positioned at an upper location in the example shown in FIG. 2 to elastically connect the mounting portion 132 and the supporting strip 137 against translational movement in the lateral direction, and the other positioned at a left-hand side location in the example shown in FIG. 2 to elastically connect the supporting strip 137 and the coupling portion 134 against translational movement in the longitudinal direction.

The piezoelectric motor 140 can have one end secured to the mounting portion 132 and the other end secured to the coupling portion 134, as illustrated in FIGS. 1 and 2. As the piezoelectric motors 140 are operated by electrical signals, etc., the piezoelectric motors 140 can move each of the multiple heads 120 by changing the positions of the mounting portions 132 in relation to the respective coupling portions 134 secured to the frame 110, so that the heads 120 may be aligned in relation to one another.

The piezoelectric motor 140 can be a motor that uses the piezoelectricity of a piezoelectric component made from PZT ($PbZr_xTi_yO_3$), etc. As in the example illustrated in FIGS. 1 and 2, the piezoelectric motor 140 can include a first unit motor 142, which may translate the head 120 in a lateral direction, and a pair of second unit motors 144, which may translate the head 120 in a longitudinal direction or rotate the head 120 about an axis perpendicular to the lateral and the longitudinal directions.

That is, the first unit motor 142 can be positioned at a right-hand side location, as in the example shown in FIG. 2, and can apply a load on the mounting portion 132 to the left or right, thereby moving the mounting portion 132, as well as the head 120 secured to the mounting portion 132, in a translational movement along the lateral direction.

Similarly, the pair of second unit motors 144 can be positioned at lower locations, as in the example shown in FIG. 2, and can apply a load on the mounting portion 132 upwards or downwards to move the mounting portion 132, as well as the head 120 secured to the mounting portion 132, in a translational movement along the longitudinal direction. Also, the pair of second unit motors 144 can apply loads on the mounting portion 132 in opposite directions, to rotate the mounting portion 132 and the secured head 120 by a particular angle in a clockwise or counter-clockwise direction.

The movement of the head 130 as effected by the piezoelectric motor 140 and the support rack 130 will be described below in more detail with reference to FIGS. 3 to 5.

First, referring to FIG. 3, when an electrical signal is transmitted to the first unit motor 142, positioned at a right-hand side location of the drawing, and the first unit motor 142 is activated, a load can be applied on the mounting portion 132 in the lateral direction. As a result, the head 120 may be translated in the lateral direction, while the elastic strip 138 positioned at an upper location of the drawing may be deformed. An elastic force can be applied on the mounting portion 132 by the elastic strip 138, so that the head 120 may maintain its position in a stable manner after the movement.

Referring to FIG. 4, when an electrical signal is transmitted to each of the pair of second unit motors 144, positioned at a lower location of the drawing, and the second unit motors 144 are activated to the same extent, a load can be applied on the mounting portion 132 in the longitudinal direction. As a result, the head 120 may be translated in the longitudinal direction, while the elastic strip 138 positioned at a left-hand side location of the drawing may be deformed. An elastic force can be applied on the mounting portion 132 by the elastic strip 138, so that the head 120 may maintain its position in a stable manner after the movement.

Also, referring to FIG. 5, when an electrical signal is transmitted to each of the pair of second unit motors 144 positioned at a lower location of the drawing such that the second unit motors 144 are operated in opposite directions, a load that rotates the mounting portion 132 in a counter-clockwise direction can be applied on the mounting portion 132. As a result, the head 120 may be rotated by a particular angle about an axis perpendicular to the lateral and the longitudinal directions, with the pair of elastic strips 138 positioned at the left-hand side and upper locations of the drawing deformed. An elastic force can be applied on the mounting portion 132 by the elastic strips 138, so that the head 120 may maintain its position in a stable manner after the movement.

A method of aligning inkjet heads according to another aspect of the invention will now be described below in more detail with reference to FIGS. 1 to 6.

Figure 6:
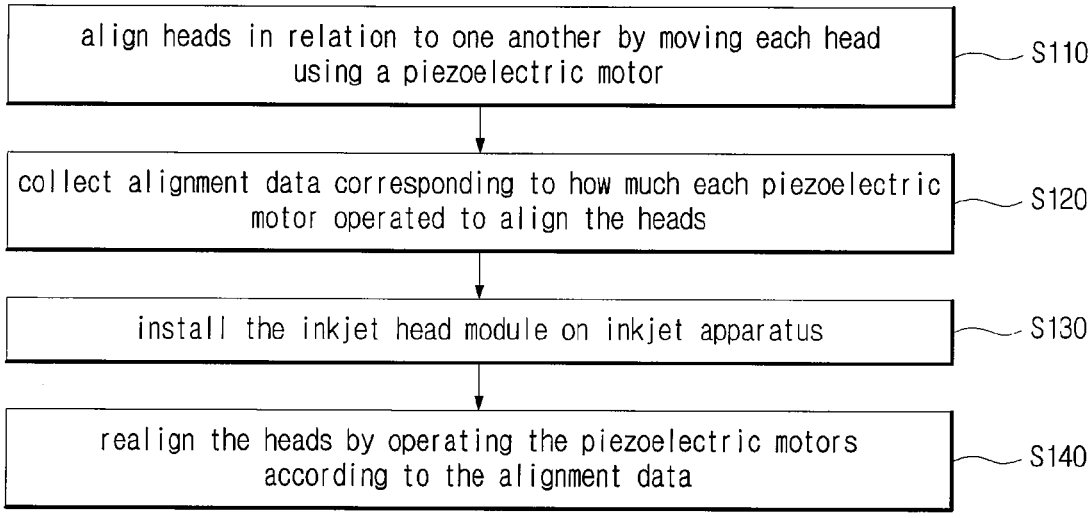
FIG. 6 is a flowchart illustrating an embodiment of a method of aligning inkjet heads according to another aspect of the invention.

FIG. 6 is a flowchart illustrating an embodiment of a method of aligning inkjet heads according to another aspect of the invention.

As illustrated in FIGS. 1 to 6, this embodiment relates to a method of aligning a multiple number of heads 120 using an inkjet head module 100 that includes a frame 110, a multiple number of heads 120, each of which is coupled to the frame 110, a multiple number of support racks 130 interposed between the frame 110 and the heads 120 to movably support the heads 120 in relation to the frame 110, and a multiple number of piezoelectric motors 140 for respectively moving the heads 120. The method can include aligning the heads 120 in relation to one another by moving the heads 120 with the piezoelectric motors 140, collecting alignment data corresponding to how much each of the piezoelectric motors 140 are operated to align the heads 120, installing the inkjet head module 100 on an inkjet apparatus, and realigning the heads 120 in relation to one another by operating the piezoelectric motors 140 in accordance with the alignment data.

According to this embodiment, the heads 120 can be aligned using an individual, modularized inkjet head module 100 that is independent from the main inkjet apparatus. Thus, parts, such as the alignment camera, etc., required for aligning the heads 120 can be omitted in the inkjet apparatus, making it possible to reduce the overall size of the inkjet apparatus.

Also, by using the piezoelectric motors 140 and the support racks 130, each of the heads 120 can be moved in minute distances, so that the heads 120 may be aligned relative to one another with greater precision.

This embodiment relates to a method of aligning the heads 120 by using an inkjet head module 100 based on an aspect of the invention as described above. The structure, functions, and operating principles of the inkjet head module 100 can be substantially the same as or similar to an embodiment described above and thus will not be described again. The procedures for aligning the heads 120 will now be described below with reference to FIGS. 1 to 6.

First, the multiple number of heads 120 can be aligned in relation to one another by moving the multiple heads 120 by use of the multiple piezoelectric motors 140 (Procedure S110). This procedure of aligning the heads 120 can be performed using an alignment system that includes an alignment camera for identifying the positions of the heads 120 and additional control units, electrical wiring, etc., for controlling the movement of the camera and the heads 120.

In other words, each of the piezoelectric motors 140 can be operated while checking the position of each of the heads 120, using the alignment camera for aligning the heads 120 in relation to one another. As in the example illustrated in FIGS. 3 to 5, a piezoelectric motor 140 can include a first unit motor 142 and a pair of second unit motors 144, to be capable of translating the head 120 in a lateral and a longitudinal direction and of rotating the head 120 about an axis perpendicular to the lateral and longitudinal directions.

Next, alignment data that correspond to how much the piezoelectric motors 140 are operated to align the heads 120 can be collected (Procedure S120). This procedure can include collecting the alignment data corresponding to how much each of the piezoelectric motors 140 are operated for aligning the heads 120, after the alignment system aligns the heads 120 in the previous procedure.

For example, each of the electrical signals supplied respectively to the first unit motor 142 and the pair of second unit motors 144, for operating the first unit motor 142 and pair of second unit motors 144, can be converted into alignment data, which may be stored by the control unit for operating the piezoelectric motors 140.

Next, the inkjet head module 100 can be installed on the inkjet apparatus (Procedure S130). This procedure can include installing the inkjet head module 100 onto the inkjet apparatus after collecting the alignment data for aligning the heads 120, using a separate alignment system.

When the inkjet head module 100 is removed from the alignment system, in order to install the inkjet head module 100 on the inkjet apparatus, power may no longer be supplied from the alignment system. Thus, the piezoelectric motors 140 may no longer be operated, and thus actions of the elastic portions 136 on the support racks 130 may restore the heads 120 to their original positions before the operation of the piezoelectric motors 140.

Next, the piezoelectric motors 140 can be operated according to the alignment data to realign the heads 120 in relation to one another (Procedure S140). As the alignment data for aligning the heads 120 has been collected in a previous procedure, the heads 120 may be realigned using this alignment data.

That is, when the inkjet head module 100 is removed from the alignment system, the actions of the elastic portions 136 can restore each of the heads 120 to its original position, so that the heads 120 may be realigned with high precision simply by inputting the pre-stored alignment data directly to the control unit that operates the piezoelectric motors 140.

While the spirit of the invention has been described in detail with reference to particular embodiments, the embodiments are for illustrative purposes only and do not limit the invention. It is to be appreciated that those skilled in the art can change or modify the embodiments, for example by appending, adding, changing, deleting, and adding components, without departing from the scope and spirit of the invention.

What is claimed is:

1. A method of aligning a plurality of inkjet heads by using an inkjet head module comprising a frame, a plurality of heads coupled to the frame, a plurality of support racks interposed between the frame and the plurality of heads, respectively, to support the heads such that the heads are movable in relation to the frame, and a plurality of piezoelectric motors configured to move the plurality of heads, respectively, the method comprising:

aligning the plurality of heads in relation to one another by moving the plurality of heads with the plurality of piezoelectric motors, respectively;

collecting alignment data corresponding to how much each of the plurality of piezoelectric motors is operated to align the plurality of heads after aligning the plurality of heads in relation to one another;

installing the inkjet head module on an inkjet apparatus after collecting the alignment data; and realigning the plurality of heads in relation to one another by operating the plurality of piezoelectric motors in accordance with the alignment data after installing the inkjet head module.

2. The method of claim 1, wherein the piezoelectric motor is configured to translate or rotate the head.

3. The method of claim 2, wherein the piezoelectric motor comprises:

a first unit motor configured to translate the head in a lateral direction; and a pair of second unit motors configured to translate the head in a longitudinal direction or rotate the head about an axis perpendicular to the lateral and the longitudinal directions.

4. The method of claim 1, wherein the alignment data corresponds to electrical signals transmitted, respectively, to each of the plurality of heads for operating the plurality of piezoelectric motors.

5. The method of claim 1, wherein the support rack provides an elastic force on the head moved by an operation of the piezoelectric motor.

6. The method of claim 5, wherein the support rack comprises:

a mounting portion having the head secured thereto;

a coupling portion separated from the mounting portion and secured to the frame; and an elastic portion interposed between the mounting portion and the coupling portion and configured to provide an elastic force on the mounting portion.

7. The method of claim 6, wherein:

the coupling portion surrounds the mounting portion; and the elastic portion comprises:

a supporting strip surrounding the mounting portion and separated from the mounting portion and the coupling portion; and a pair of elastic strips connecting the mounting portion with the supporting strip and connecting the coupling portion with the supporting strip, respectively.

* * * * *